US005524304A

United States Patent [19]

Shutes

[11] Patent Number: 5,524,304

[45] Date of Patent: Jun. 11, 1996

[54] BED RAIL MOUNTED DRIVE UNIT FOR PATIENT POSITIONER

[76] Inventor: Robert S. Shutes, 115-6th St., Cloquet, Minn. 55720

[21] Appl. No.: 325,985

[22] Filed: Oct. 19, 1994

[51] Int. Cl.[6] ..... A61G 7/08

[52] U.S. Cl. ..... 5/81.1 R; 5/88.1

[58] Field of Search ..... 5/81.1, 84.1, 88.1, 5/424, 494

[56] References Cited

U.S. PATENT DOCUMENTS

| | | | |
|---|---|---|---|
| 658,217 | 9/1900 | Munger | 5/88.1 |
| 1,334,901 | 3/1920 | Higdon . | |
| 1,934,302 | 11/1933 | Greenwood | 5/88.1 |
| 2,439,066 | 4/1948 | Vanderlyn et al. | 5/88.1 |
| 2,774,079 | 12/1956 | Flatley | 5/84.1 |
| 2,812,524 | 11/1957 | Pruitt | 5/61 |
| 3,099,842 | 8/1963 | Jensen | 5/84.1 |
| 3,302,219 | 2/1967 | Harris | 5/85 |
| 3,458,878 | 8/1969 | Combs | 5/424 |
| 3,488,098 | 1/1970 | Sotoczak | 308/6 |
| 3,827,089 | 8/1974 | Grow | 5/61 |
| 3,874,010 | 4/1975 | Geary | 5/61 |
| 3,884,225 | 5/1975 | Witter | 128/133 |
| 3,895,403 | 7/1975 | Davis | 5/81 |
| 3,954,281 | 12/1975 | Gibbs | 5/81 |
| 4,180,879 | 1/1980 | Mann | 5/424 |
| 4,361,918 | 12/1982 | Røisaeth | 5/81 |
| 4,459,712 | 7/1984 | Pathan | 5/81 |
| 4,490,867 | 1/1985 | Gabrielsson | 5/509 |
| 4,502,169 | 3/1985 | Persson | 5/88 |
| 4,507,814 | 4/1985 | Zyki, Jr. | 5/84.1 |
| 4,536,903 | 8/1985 | Parker | 5/81.1 |
| 4,675,925 | 6/1987 | Littleton | 5/61 |
| 4,751,918 | 6/1988 | Bernard et al. | 128/57 |
| 4,776,047 | 10/1988 | DiMatteo | 5/81 |
| 4,843,665 | 7/1989 | Cockel et al. | 5/88.1 |
| 4,872,226 | 10/1989 | Lonardo | 5/61 |
| 4,937,901 | 7/1990 | Brennan | 5/61 |
| 4,939,801 | 7/1990 | Schaal et al. | 5/61 |
| 5,005,231 | 4/1991 | Lonardo | 5/81.1 |
| 5,018,225 | 5/1991 | Fergni et al. | 5/61 |
| 5,168,587 | 12/1992 | Shutes | 5/81.1 |
| 5,274,862 | 1/1994 | Palmer, Jr. et al. | 5/81.1 |

FOREIGN PATENT DOCUMENTS

| | | | |
|---|---|---|---|
| 8510833 | 11/1985 | China . | |
| 201160 | 1/1983 | Czechoslovakia . | |
| 2350831 | 5/1976 | France . | |
| 2624007 | 6/1989 | France . | |
| 3509262 | 3/1985 | Germany . | |
| 3438956 | 5/1985 | Germany | 5/88.1 |
| 1447163 | 8/1976 | United Kingdom . | |

*Primary Examiner*—Michael J. Milano
*Attorney, Agent, or Firm*—Haugen and Nikolai

[57] ABSTRACT

A patient positioning device for manipulating mobility impaired patients. A specially dimensioned corset is adapted to be positioned around the torso of the patient and is coupled to two flexible straps which are individually routed to two drive assemblies designed for attachment on the vertically positionable safety side rails of the bed. A relay based control apparatus controlling the take up and play out of the straps to the two drives for regulating the movement of the corset and the patient.

11 Claims, 4 Drawing Sheets

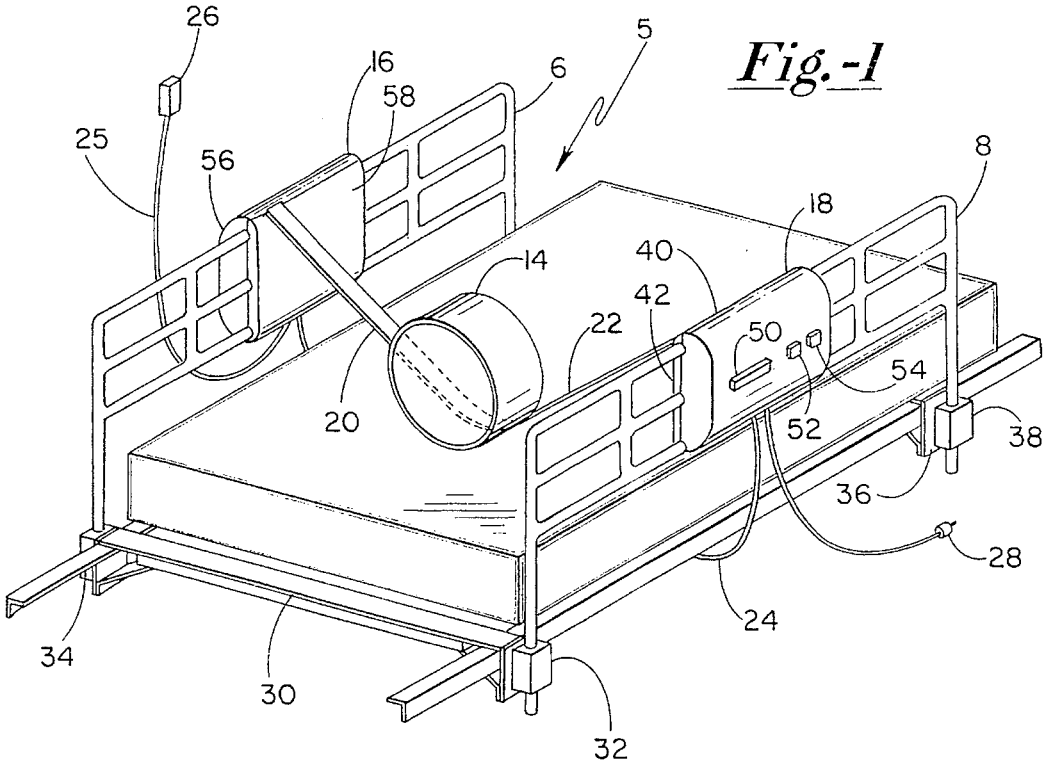
Fig.-1
Fig.-2
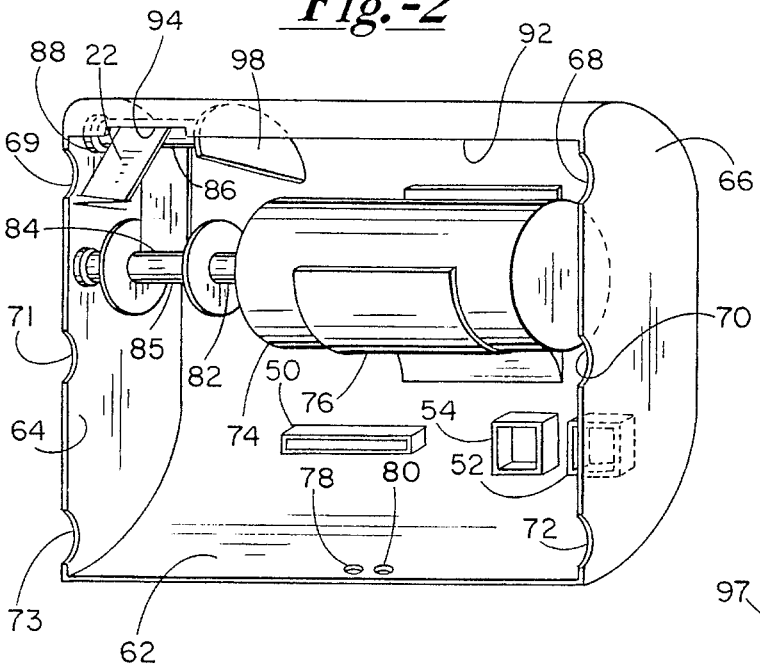
Fig.-3
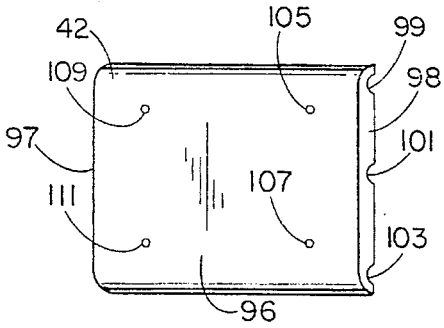

BED RAIL MOUNTED DRIVE UNIT FOR PATIENT POSITIONER

I. FIELD OF THE INVENTION

The present invention relates to a device for rotating or repositioning a mobility impaired patient in bed and more particularly to a bed rail mounted drive unit for controlling the rotation or repositioning of the patient.

II. BACKGROUND OF THE INVENTION

A patient often may be dependent upon the manual assistance of caregivers changing the patient's position in bed. Patients who are mobility impaired because of either disease or accident live in a variety of settings, including hospitals, nursing homes, rehabilitation centers, hospices and their own homes. The inability to move in bed causes patient discomfort and may lead to the development of decubitus ulcers (bed sores). Regular periodic movement of the mobility impaired patient is thus necessary, but is a laborious task for the caregivers. The manual assistance by a caregiver in moving the patient often results in back injury to the caregiver. Frequently two or more aides are required to manually lift and reposition the patient. Furthermore, in medical settings such as hospitals and nursing homes, the task of repositioning a patient is time consuming, thereby reducing the time available for other patient care needs.

It has generally been known to mechanically turn the bed sheets or pad on which the patient lies. In particular numerous mechanized devices are available which turn the patient utilizing movement of an underlying soft, flexible material. All are mechanized variants of the turning sheet and pad positioned underneath the patient that was commonly used at the beginning of the century. When it became necessary to turn the patient, the caregiver would pull at the edges of the turning sheet and a frictional engagement would cause the patient to be rolled on the pad, such as disclosed in U.S. Pat. No. 1,334,901 issued to Higdin.

Another variant of a manual apparatus for positioning patients is provided in U.S. Pat. No. 4,872,226, issued to Lonardo. This apparatus includes a rectangular bed pad which is located on the bed surface and extends at least from above the shoulders of the patient to a point at least below the hip areas. It is fitted with a pair of straps which is secured to the pad to extend transversely across the pad in substantial alignment with the shoulders and hip areas of the patient. Various straps are attached to the pad to effect movement of the patient into a preselected position by pulling up the straps. This device is not mechanized and relies upon the caregiver to pull on hand gripping loops which are positioned at various points in the straps. Thus, the patient is once again positioned by manual effort from caregivers, which is strenuous, time consuming and may lead to back injury and to insurance or worker's compensation claims. Consequently, it frequently occurs that the patients are not turned as often as they should be, which results in serious health problems, such as bed sores. More recent variants of this apparatus utilize essentially the same principle, but have substituted a mechanized force for that previously exerted by the caregiver.

An example of a mechanized apparatus for turning a person confined to a bed is disclosed in U.S. Pat. No. 4,502,169, issued to Person. This apparatus includes an adjustable frame which is applied to a bed. This frame supports selectively rotatable rolls positioned at the level of the bed mattress. The rolls are connected to an electric motor. A draw sheet extends between the rolls, across the upper side of the bed and is wound on both rolls. The patient lies on top of the draw sheet. When electric motor is turned on by a patient or caretaker, the draw sheet is pulled in a preselected direction and the patient is turned by friction produced between the patient's body and the sheet. The efficacy of the turning force produced is dependent upon several external factors, including the size of the patient and the texture of the fabrics comprising the draw sheet and patient apparel. A more predictable and controllable turning mechanism is, therefore, desirable.

An additional drawback to the Persson device is that it is bulky, which tends to obstruct the patient's care and also the ability of the patient to be transferred into and out of the bed. Further, special linens are required and they may need to be changed frequently, especially in cases of incontinence. Because of the roller mechanism, changing linens is a time consuming chore.

In other arrangements, the bed assembly itself may turn so as to deposit the immobilized patient onto a separate mattress. An example of a turn over bed assembly is disclosed in U.S. Pat. No. 3,827,089 issued to Grove. It includes a mattress which is movably supported on a rotationally movable carrier frame. A patient lying on the lower mattress and who wishes to change position from face down to face up, or vice versa, is strapped by a caregiver to the mattress upon which the patient presently lies. Then, upon engagement of the controls by the caregiver, the assembly is rotated one quarter revolution. The mattress upon which the patient had been lying is secured for movement towards the opposite mattress, and then a succeeding quarter turn positions the patient in the desired new position on the opposing mattress. The mattress upon which the patient had previously been lying has been retracted on its support rails. The dual mattress apparatus is very bulky and quite expensive. Also, it has limited utility since the patient is either deposited face up or face down. To shift a patient to one side or the other still requires manual intervention by the caregivers.

A vast improvement over the prior art has been realized by applicant's own earlier invention described in U.S. Pat. No. 5,168,587. It uses a corset for surrounding the patient's torso. A pair of straps attached to each side of the corset are routed over the side railings of the bed and joined to a power take-up device located underneath the patient's bed. Operation of the power take-up device applies tension to one strap to effect rotation of the patient. Because of the location of the device unit beneath the bed frame, it has been found that applicant's earlier invention is not universally applicable to all hospital beds. Also, the side railings of some hospital beds are not sturdy enough to accommodate the stresses developed on them by the engagement of the straps therewith. For example, beds with separate side rails at the head and front of the bed lack necessary rigidity. Thus, a need exists for a less bulky, nonobstructive device which is universally applicable to most hospital beds now commonly in use.

OBJECT

Therefore, it is a principle object of the present invention to provide a new and improved apparatus to reduce the manual effort required of caregivers by providing a device universally applicable to beds in common use which will predictably and easily effectuate the positioning of a mobility impaired person in bed.

Yet another object of the present invention is to provide a new and improved apparatus for positioning patients which is adjustably mounted to the bed rails of beds in common use.

Still another object of the present invention is to provide a new and improved apparatus for positioning patients which may be operated by a single caregiver or by the patient.

Another object of the present invention is to provide a new and improved apparatus which is low cost and easy to install in existing bed equipment.

A still further object of the present invention is to provide a new and improved apparatus for safely turning a mobility impaired patient using a patient corset operatively coupled to an electric motor or other suitable drive mechanism.

Another object of the present invention is to provide a new and improved apparatus for turning a mobility impaired patient which does not require bulky equipment, hence it is not obtrusive and does not interfere with the patient care when transferring the patient into or out of bed.

It is another object of the present invention to provide a new and improved apparatus for turning a mobility impaired patient that does not require the use of specially designed bed linens or draw sheets.

Still a further object of the present invention is to provide a new and improved apparatus for turning a mobility impaired patient that utilizes existing beds having standard retractable bed rails.

SUMMARY OF THE INVENTION

The foregoing objects and advantages of the invention are achieved by providing a patient positioning device for attachment to a bed where the bed is provided with side rails for preventing a patient from rolling onto the floor. The patient positioning device comprises first and second drive assemblies respectively attached to first and second side rails located on opposite sides of the bed. Each of the drive assemblies include a side rail mounted housing structure containing power reels or other equivalent arrangements for applying tensioning forces to elongated, flexible straps such as powered pinch rollers. The housing structure may be mounted anywhere along the length of the rail. The design of the housing and its ability to be shifted longitudinally on the bed rail renders it non-obtrusive and does not interfere with the operation of the bed rails.

The patient has a corset adapted to surround the lower torso and hip region and affixed to the corset are first and second straps. The straps are suitably coupled to the drive reels or pinch rollers contained within the side rail mounted housings. By actuating an appropriate switch, the drive unit on one side rail winds up a strap while the drive unit one the opposite rail plays out the other strap to thereby rotate and translate the patient relative to the bed's mattress.

The invention is universally applicable to hospital beds in common use. If the need arises to reinforce the bed railing a specially designed reinforcing bed frame mounting bar and bed rail swivel brackets are provided.

The aforementioned objects and advantages of the invention will become subsequently apparent and reside in the details of the construction and operation is more fully hereinafter described and claimed, reference being had to the accompanying drawings forming a part thereof, wherein like numerals refer to like parts throughout.

DESCRIPTION OF THE DRAWINGS

FIG. 1 is a perspective view of a hospital bed on which the preferred embodiment of the present invention is installed;

FIG. 2 shows a perspective of a portion of the housing and drive unit of the present invention contained therein;

FIG. 3 is a perspective view of the clamping plate used to secure the housing and drive unit to the bed's side rails;

DESCRIPTION OF THE PREFERRED EMBODIMENT

Figure 4:
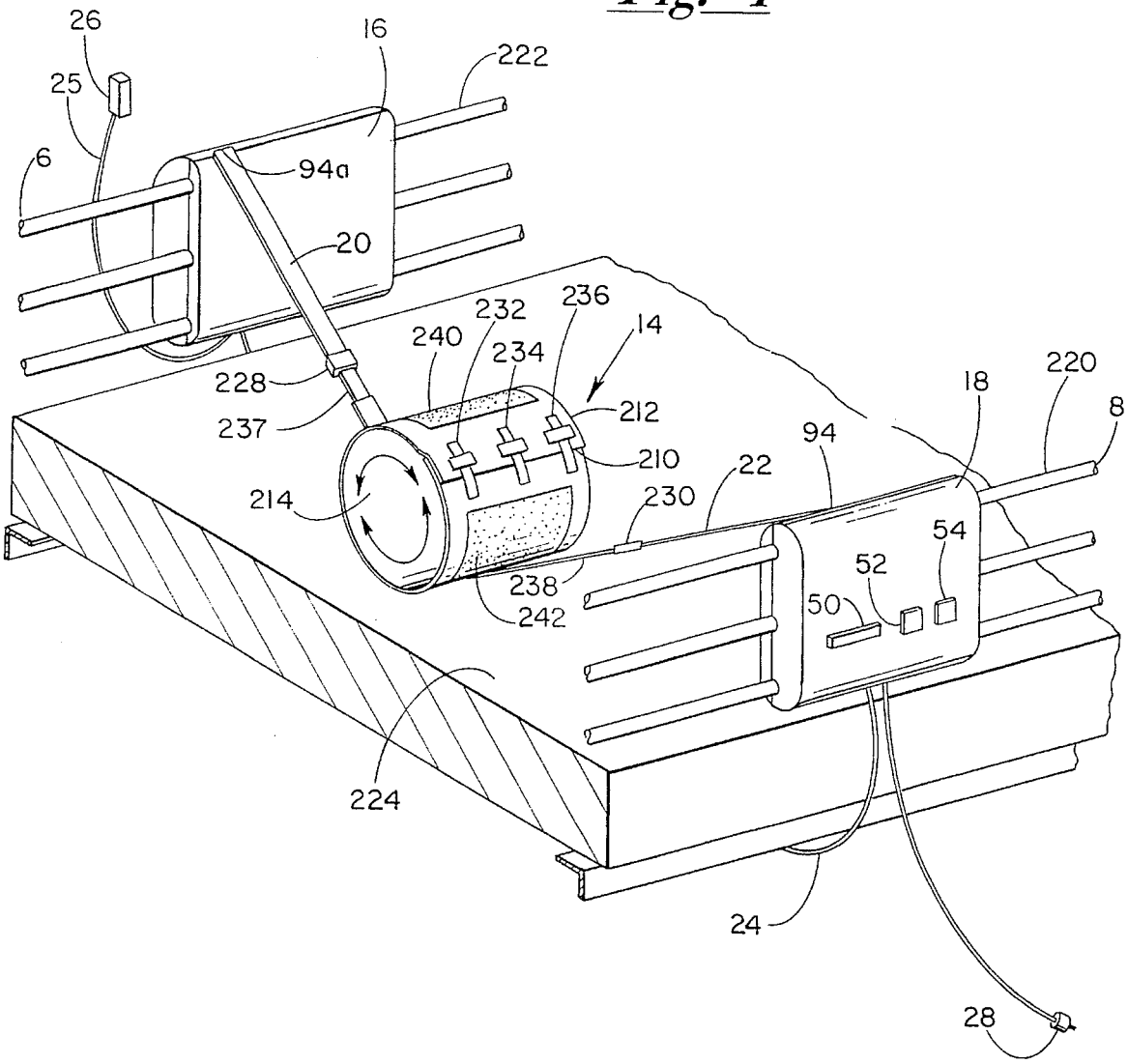
FIG. 4 is an enlarged portion of FIG. 1 showing the features of the patient corset and strap routing.

The preferred embodiment of the patient positioning device is shown generally as 5 in FIG. 1. The device is adapted for use with a variety of existing patient beds which have conventional side rails, such as 6 and 8 shown in FIG. 1 which can be raised and lowered to safely confine the patient. The device consists of a patient corset 14 and two rail-mounted drive assemblies 16 and 18. A first strap 20 extends between patient corset 14 and left drive assembly 16. Likewise, an identical strap 22 extends between patient corset 14 and right drive assembly 18. The two drive assemblies are linked together by a common power cord 24 adapted to be connected to a 110 volt wall plug 28. As will be described in greater detail below, the drive system is controlled by control module 26 or by button controls located on the individual drive assemblies.

In the event the bed rails 6 and 8 are not sufficiently rigid to withstand the force of moving the patient, a reinforcing bed frame mounting bar 30 may be positioned across the width of the bed at the opposed ends of the rails 6 and 8 as disclosed in FIG. 1. The reinforced bed frame mounting bar 30 contains bed rail leg sockets 32 and 34 which receive the leg of the bed rails 6 and 8. A second reinforcing bar 36 is also shown in FIG. 1 at the head of the bed with a bed rail leg socket 38.

As stated above, the patient positioning system preferably consists of two rail mounted drive assemblies 16 and 18, but those skilled in the art will appreciate that only a single drive assembly will suffice if the straps are appropriately deployed. The exterior housing of each drive assembly is smooth, free of sharp edges and electrically nonhazardous to prevent injury to the patient or the caretaker. As shown in FIG. 1, the drive assembly 18 has a housing cover 40 located on the outboard side of side rail 8. A generally flat backing plate 42 (FIG. 3) is located on the inboard side of rail 8 and is dimensioned so as not to interfere with the mattress as the side rails are raised or lowered.

The exterior of housing cover 40 contains an emergency shutoff switch 50 along with strap tension adjustment push button-type switches 52 and 54. These switches are positioned to be readily accessible to the care attendant and are operatively connected between the power source and a drive motor 74 (FIG. 2). Emergency shutoff switch 50 is shown as a simple bar-type push button located on the flat outer surface of the drive unit housing. The push button switches 52 and 54 allow each drive assembly motor to be operated in the proper direction to effectuate slack take-up. Without limitation, the overall thickness of the drive assembly housing is preferably about 4" or less and the length of the unit is preferably about 14" or less. The vertical dimension should be enough to cover all three horizontal members of the bed railing, plus an additional amount to accommodate an idler roller 86 located in the upper inside corner of the drive unit and positioned at an elevation that is adjacent to the top rail.

Drive assembly 16 is substantially identical in construction to drive assembly 18. It too has an housing 56 located on the outboard side of rail 6 with a backing plate 58 on the inboard side of the rail. Drive assembly 16 also contains an emergency shutoff switch and a pair of push button-type switches (not shown) for strap tension adjustment. Hence, the strap tension can be easily adjusted by a nursing attendant.

As seen in FIG. 2, the housing cover for each of the drive assemblies include a smoothly curved front wall 62 having orthogonally extending end walls 64 and 66. The exposed edges of end walls 64 and 66 include semicircular cutouts 68, 69, 72, 73 for accommodating the horizontal bed rails. The upper edge 92 of front wall 62 contains a notch 94 for forming an upper surface of a strap guide.

The drive motor 74 is secured within the housing cover by means of a motor mounting bracket 76. The motor has a power cord 28 shown in FIG. 1, which extends through power cord port 78 in housing cover 18. A power linkage cord, shown as 24 in FIG. 1, extends through power linkage cord port 80, and connects the motor in drive assembly 18 to that in drive unit 16. The drive motor is preferably a gear reduction electric motor which may operate on the standard 110 volt current. To protect the patient or caregiver from electrical hazards, this motor is controlled by a low voltage switch and relay system that isolates the control switch from the voltage that actually drives the motor as will be explained later in greater detail.

Operatively coupled to drive motor 74 is a shaft 82 which supports a slotted drive reel 84. An idler roller 86 is located in the housing cover proximate the upper bed rail cutout 69 and is journaled on roller bushings. One such roller bushing 88 is shown as being mounted to the side of housing cover 18. The other roller bushing (not shown) is mounted to bushing mounting plate 98 which in turn is mounted to the housing cover 40. The idler roller 86 is also placed proximate the bed rail cutout 69 to reduce rubbing of the strap on the bed rail and protect the chrome plating on the railings. FIG. 2 shows the positioning of strap 22 on the idler roller 86 and slotted drive reel 84. The end of strap 22 is inserted into a slot 85 for securing the strap to the drive reel 84.

Turning now to FIG. 3, the housing backplate 42 is depicted at a reduced scale compared to the view of FIG. 2. It consists of a smooth outer wall 96 with ends 97 and 98 extending perpendicularly to wall 96 and sized to close the back of housing cover 62 when the assembly is mounted on the bed rails. Specifically, the ends have bed rail cutouts, such as shown at 99, 101 and 103 on end 98. These cutouts conform to the bed rail cutouts 69–73 on housing cover 62. Also located on housing backplate 42 are mounting screw holes 105, 107, 109, and 111. These are used to secure the housing backplate 42 to brackets (not shown) mounted on housing cover 62 and used to secure the drive assembly to the rails. Any suitable bracket may be used to secure the drive assembly to the rails, provided that they are contained within the housing. The brackets used should permit the drive assembly to be adjustable along the length of the side rail. When the drive assemblies are positioned on the bed's side rails the peripheral edge of the housing cover 62 abut the peripheral edge of the backing plate 42 with the exception that the cutouts encompass the horizontal rails of the side rail assemblies 6 and 8.

The arrangement of component parts in the interior of housing 60 is substantially identical to that in housing 40 previously described with reference to FIGS. 2 and 3. The two ports located in housing 60, however, are slightly different. One port (not shown) is for power linkage cord 24 used to connect drive assemblies 16 and 18 together. The second port (not shown) is for a cord 25 which extends to control module 26. The drive motors are controlled with a switching relay control which will be explained in greater detail later. The activity of the motors is synchronized such that if drive assembly 18 reels in strap 22, drive assembly 16 is playing out strap 20 at the same rate.

With reference now to FIGS. 1 and 4, the patient corset 14 will now be described in further detail. The patient corset 14 is available in a variety of sizes to accommodate a particular patient's torso and relevant physical disabilities. It includes a suitable reclosable fastener e.g., hook and loop closure material (VELCRO®) at cuff opening 210. Preferably, the corset is constructed of a bilayer fabric. The exterior layer 212 is preferably a flexible, stretch resistant fabric, such as a rip-stop nylon or a tightly woven synthetic or siliconized material having reduced friction properties, allowing the corset to easily slide relative to the bed sheets. This reduces the force required on the strap, facilitates the change of position, and improves patient comfort. The interior layer 214 of the corset 14 is preferably soft and absorbent material, such as flannel or medium weight canvas, for increased patient comfort.

The straps 20 and 22 are preferably constructed of heavy duty webbing, having no seams or buckles along their length as shown in FIG. 1, and are attached to the corset 14 in regions corresponding to the sides of the patient's torso. With no limitation intended, an example of suitable webbing includes a woven synthetic covering adhered to both sides of an amorphous synthetic core, such as Seigler U.S.A. TT2 Belting. Alternatively, the straps may be made of a woven synthetic or natural fiber webbing or fabric, leather, flexible plastic or synthetic materials, or of a fabric or webbing reinforced with steel or other metal mesh. The straps may be sewn, riveted, fused or otherwise permanently affixed to the corset 14. Alternatively, a fastening material, such as Velcro, may be used to secure the straps to the corset.

The straps 20 and 22 are oriented so that when they are laid flat along the circumference of the corset, they can extend underneath the patient's body toward bed rails 6 and 8. The top rails 220 and 222 of each bed rail assembly 6 and 8 are positioned somewhat higher than the top surface of mattress 224 when the bed rails are in their "up" position. Straps 20 and 22 are routed to the strap guide slots 94 and **94*a* located in the cover members of drive assemblies 16 and 18 which reside proximate the upper surface of the top rail 220 or 222. The elevated slot in the housing creates an angle between the mattress 224 and the strap. This serves to provide a blended movement of lateral shifting and rotation of the patient about his or her mid-axis. Having the strap pass into the elevated slot also provides a measure of lift to the patient and thereby additionally reduces the friction of the patient against the bed. Each of straps 20 and 22 extend over the idler roller 86 of their respective drive unit and then are connected to the drive reel 84** as described previously.

In an alternative embodiment of corset 14, hook and loop closure strips 232, 234 and 236 provide a convenient way of securing the corset 14 in place about the patient, although zippers, buckles or snaps may be also used for this purpose. The alternative embodiment also may have each strap 20 and 22 terminating in a buckle member 228 and 230 respectively. Two additional straps are then used between the buckles and the corset. Strap 237 is adjustably secured to the buckle 228. Strap 237 may pass under the corset 14 and have its free end affixed to a hook and loop fastener pad 242 on the opposite side of the corset 14 or, alternatively, the free end of the strap 237 can be affixed directly to the hook and loop fastener 240. Likewise, strap 238 is appropriately affixed to the buckle 230 and the corset 14. Strap 238 may extend beneath the corset 14 such that its free end is attached to hook and loop material 240, or alternatively, the strap 238 may attach at its free end directly to the pad 242.

Figure 5:
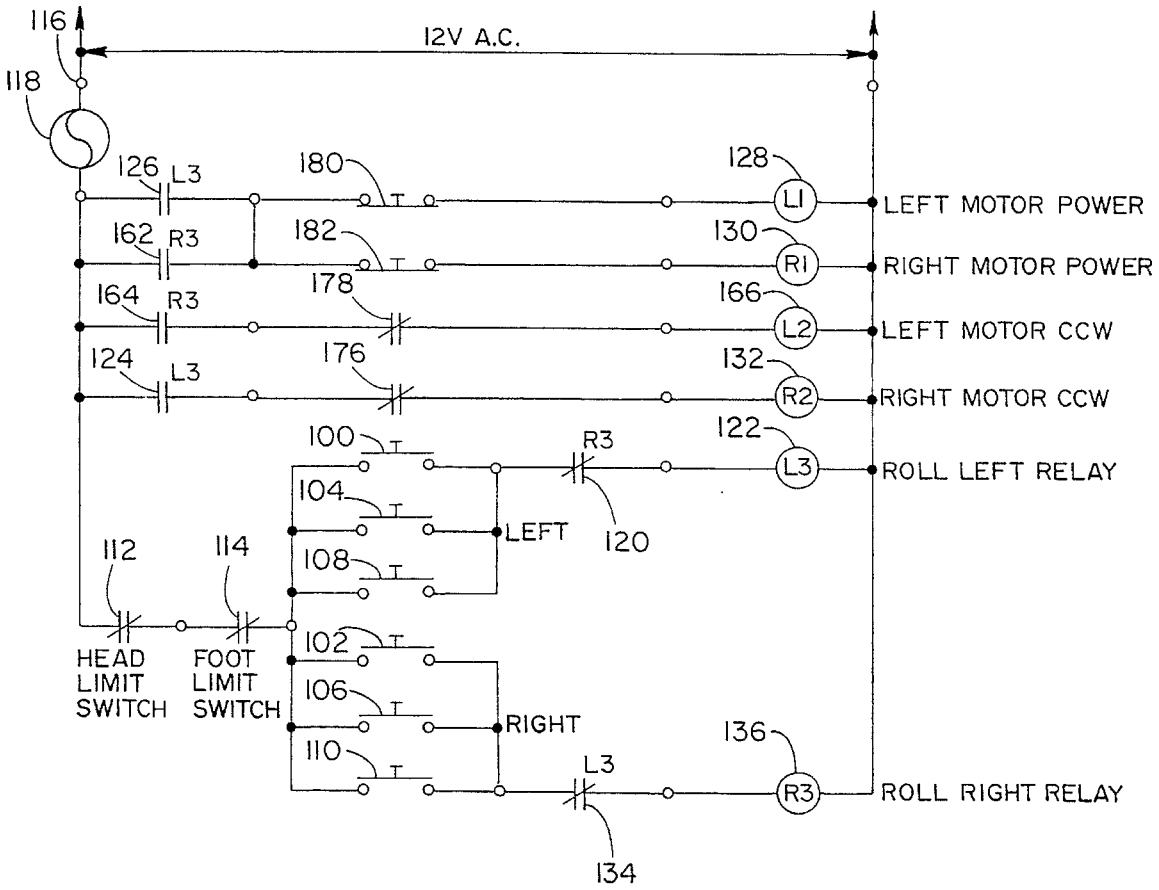
FIGS. 5 and 6 are schematics of the circuitry of the preferred embodiment.

Turning now to FIG. 5, the schematic of the circuitry of the control unit for the patient turning device will now be described, The handheld control module 26 is intended for both patient and care attendant use and contains two push button actuated switches which correspond to the numerals 100 and 102 in FIG. 5. Push button actuated switch 100 is depressed, allowing the patient to be turned to the left. For turning to the right, push button switch 102 is depressed. In addition to the control module 26, each drive unit assembly has push buttons accessible to an attendant for adjusting slack in the straps. The right drive assembly 18 has a roll left push button 52 corresponding to switch 104 in FIG. 5 and a roll right push button 54 corresponding to switch 106 in FIG. 5. Likewise, the left drive assembly 16 has a roll left push button corresponding to switch 108 and a roll right push button corresponding to switch 110.

To operate the drive assemblies, it is required that the bed be level. Therefore a head limit switch 112 and a foot limit switch 114 are incorporated into the design. Level magnetic switches which require no current to operate are one type of limit switch which may be used. If the head or foot of the bed is raised or lowered, the drive assemblies will not work because the normally closed limit switch 112 or 114 will be open. The current which flows through terminal 116 and through fuse 118 cannot energize the remaining portion of the circuit to power the motors of the drive assemblies.

The energization of the circuit will first be described for turning the patient to the left. To move the patent to the left, push button switch 100 on the handheld control module 26 will be closed. If the bed is level, the current flows through the closed limit switches 112 and 114 and the closed push button switch 100. If the bed is not level, no current will flow. The bed must first be leveled before further operation of the device can occur.

The current flows through normally closed relay contact 120 to energize relay 122 causing contacts 124 and 126 to reverse from normally open to closed. Relay 128 is energized to power the left motor to rotate its shaft in a clockwise direction. Relay 130 is energized to power the right motor and relay 132 is energized to cause the right motor to rotate its shaft counterclockwise. Contact 134 in series with relay 136 opens to prevent energization of relay 166 which inhibits rotating the left motor shaft in a counterclockwise direction.

Figure 6:
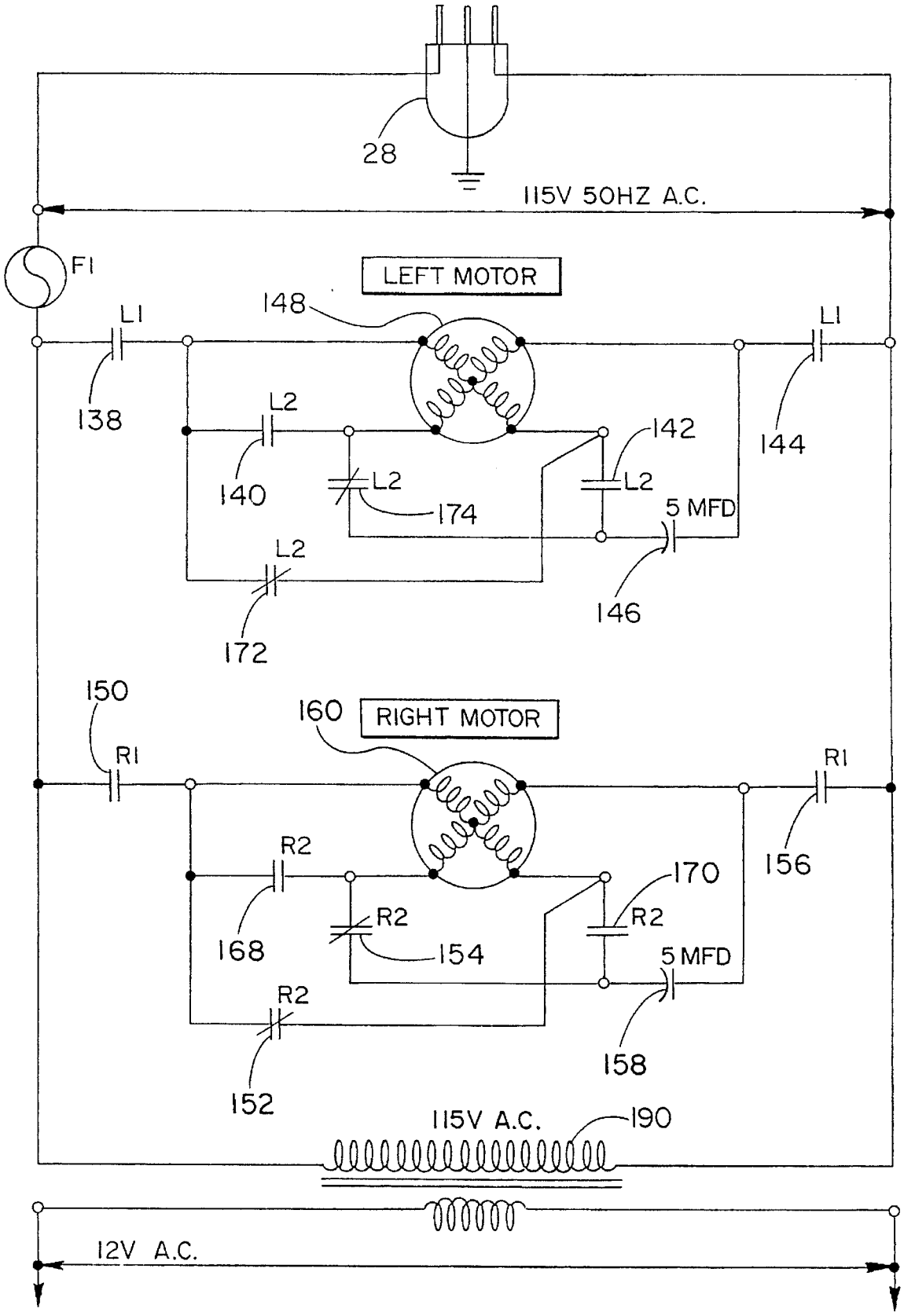

Turning now to FIG. 6, the left side motor 148 is connected across the AC power and driven in a clockwise manner as the current flows through the left motor relay contacts 138, 140, 142, 144, 5 MFD capacitor 146 and motor windings 148. This causes the strap 20 to be drawn into the left side drive assembly 16 as it wraps around its power reel. In the meantime, relay contacts 150, 152, 154 and 156 are closed in the right motor 74 causing the right motor to rotate the power reel 85 in a counterclockwise direction to let out the strap 22.

If it is desired to turn the patient to the right, the operator depresses the button associated with switch 102 on the handheld control module 26. If the bed is level, current will flow through the head and foot limit switches 112 and 114, through the closed push button switch 102, 106 or 110 and closed relay contact 134 to energize relay 136. Contact 120, in series with relay 122, opens to prevent relay 132 from being energized to rotate the right motor counterclockwise.

Energization of relay 136 causes contacts 162 and 164 to reverse which, in turn, energizes relays 128 and 130 to power the right and left motor. Relay 166 is also energized which causes the left motor shaft to rotate counterclockwise.

Turning now to FIG. 6, the right motor is connected across the AC power as current flows through relay contacts 150, 168, 170 and 156, 5 MFD capacitor 158 and windings 160 of the motor. The right motor shaft is driven clockwise and strap 22 is taken up by power reel 85. The left motor is also connected across the AC power and driven counterclockwise as current flows through relay contacts 138, 144, 172, 174, 5 MFD capacitor 146 and motor windings 148. This causes strap 20 to be let out.

While the motors operate on 115 volts, a transformer 190 is located between the motor circuitry and control buttons to reduce the operating potential to 12 volts. The circuitry shown in FIG. 5 also incorporates a preset or adjustable limit switch 176 for breaking the circuit when the maximum extension of the strap 22 from the right motor has been reached. Likewise, a preset or adjustable limit switch 178 breaks the circuit when the left strap 20 has reached it maximum extension. This enhances patient safety by establishing the total strap travel distance.

The circuit also includes two normally closed push button contacts 180 and 182. These correspond to the emergency shut-off push buttons. Depression of either one will result in cutting the power to both motors. The right strap 22 may be initially adjusted if either push buttons 52 or 54 are depressed. The left strap tension is adjusted in a similar manner. Strap 20 is then loosened or tightened depending upon whether the left motor is rotating the power reel clockwise or counterclockwise.

The operation of the device will now be described for turning the patient on his or her left side so that he or she faces rail 6. The straps 20 and 22 must first be tensioned appropriately through the use of the tension control switches 52 and 54 or the corresponding pair of switches on unit 16. Once the straps have the appropriate tension, the appropriate push-button on the control module 26 is manipulated to cause drive motor 74 of drive unit 18 to rotate its shaft in the clockwise direction. This causes the drive reel 84 to likewise rotate in a clockwise rotation causing the strap 22 to wind up on slotted drive reel 84. At the same time, the drive assembly 16 is releasing strap 20 from its drive roller (not shown). Because of the manner in which the straps are routed through the strap slot in their respective drive units as the patient is pulled toward one of the bed rails, the angle of pull begins to increase and imparts a steady increasing force of rotation. The patient, thus, experiences a blended type of movement that is first primarily a lateral shift, which in a second phase becomes more rotational. This transition occurs smoothly and gradually, producing an improved sense of comfort and a more effective turning process when compared to having the strap in a horizontal orientation.

The device incorporates several safety features such as the low voltage switches on the handheld control, mercury switches to allow operation of the device only when the bed is horizontal, preset or adjustable limit switches which establish the total strap travel distance and safety guides to keep fingers, clothes and garments from being pinched between the bed rails and straps. Excessive pulling force on the patient via the straps may be limited by the use of hook and loop closure material in joining the straps to the corset, torque limiters or slip clutches on the drive unit, or the use of fabrics and seams designed to rip apart under excessive tension forces.

A significant advantage of the patient positioner device of the present invention is that simple, inexpensive parts can be used to retrofit any existing patient bed and bed rail system. It is no longer necessary to locate the strap drive unit beneath the bed. It merely requires that the bed rails be securely affixed to the bed frame and strong enough to withstand the forces produced by movement of the straps as they pull against the weight of the patient. The device is not limited to a particular motor or motor system or a particular roller guide configuration. For example, only one rail mounted motor driven reel may be used in conjunction with a passive assembly on the other rail which includes routing rollers for a single continuous strap. Any alternative drive unit which can readily be affixed to the bed rails will meet the requirements of the present invention.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed:

1. A patient positioning device for attaching to a bed having a pair of safety side rails that may be raised to prevent a patient from falling out of bed and lowered to facilitate patient ingress and egress, said patient positioning device comprising:

(a) a patient corset means for wrapping around a patient torso;

(b) a drive assembly mounted to at least one of said pair of safety side rails of said bed, said drive assembly comprising:

(i) a housing;

(ii) a reversible drive motor mounted in said housing; and (iii) a reel mechanism for receiving said second end of said strap means, said reel mechanism coupled to said reversible drive motor;

(c) a strap having a first end attached to said patient corset and a second end coupled to said drive assembly; and (d) a control means attached to said drive assembly for regulating the movement of said strap.

2. The patient positioning device of claim 1 wherein said drive assembly is slidably adjustable along a length of said side rail.

3. The patient positioning device of claim 1 further including means for reinforcing a frame of said bed, said means for reinforcing supporting said pair of safety side rails.

4. The patient positioning device of claim 1 wherein said housing has control switch means for adjusting tension of said strap.

5. A patient positioning device for attachment to a bed of the type including a bed frame, a mattress supported by said bed frame, means for selectively elevating the head and foot of the bed and vertically adjustable side rails for preventing a patient from rolling onto the floor, said patient positioning device comprising:

(a) a patient corset adapted to be wrapped around a patient torso;

(b) a first drive assembly mounted to a first side rail of said bed, said first drive assembly comprising:

(i) a first housing slidably adjustable along a length of said first side rail, said first housing removably affixed to said first side rail;

(ii) a first reversible drive assembly mounted in said first housing; and (iii) a first reel mechanism receiving said second end of said first strap, said first reel mechanism being coupled to said first reversible drive assembly;

(c) a second drive assembly mounted to a second side rail of said bed;

(d) a first strap having a first end attached to said patient corset and a second end attached to said first drive assembly;

(e) a second strap having a first end attached to said patient corset and a second end attached to said second drive assembly; and (f) a control means operably attached to said first and second drive assembly for regulating the movement of said first and second straps in a nonconflicting manner.

6. The patient positioning device of claim 5 wherein said second drive assembly comprises:

(a) a second housing slidably adjusted along a length of said second side rail, said second housing removably affixed to said second side rail;

(b) a second reversible drive assembly mounted in said second housing; and (c) a second reel mechanism for receiving said second end of said second strap, said second reel mechanism coupled to said second reversible drive assembly.

7. The patient positioning device of claim 5 wherein said first drive assembly has a first control switch means for tension adjustment of said first strap and said second drive assembly has a second control switch means for tension adjustment of said second strap.

8. The patient positioning device of claim 5 and further including means for reinforcing a frame of said bed and means for supporting said bed rails on said means for reinforcing said frame.

9. The patient positioning device of claim 7 and further including a motor control circuit responsive to said first and second control switches for selectively driving said first and second drive assemblies in opposite directions in a coordinated manner.

10. The patient positioning device of claim 9 wherein said motor control circuitry includes means for inhibiting operation of said first and second drive assemblies if the head or foot of the bed is elevated from the horizontal.

11. The patient positioning device of claim 9 wherein said motor control circuit includes first and second limit switches for disabling operation of said first and second drive assemblies when said first and second straps have moved a predetermined distance.

* * * * *